US009405213B2

(12) United States Patent
Arasawa et al.

(10) Patent No.: US 9,405,213 B2
(45) Date of Patent: Aug. 2, 2016

(54) OPTICAL-WRITING-HEAD POSITIONER AND IMAGE FORMING APPARATUS INCORPORATING SAME

(71) Applicants: Shinichi Arasawa, Hyogo (JP); Takahiro Yoshimi, Hyogo (JP); Kenji Nakamura, Osaka (JP)

(72) Inventors: Shinichi Arasawa, Hyogo (JP); Takahiro Yoshimi, Hyogo (JP); Kenji Nakamura, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/807,438

(22) Filed: Jul. 23, 2015

(65) Prior Publication Data

US 2016/0026111 A1 Jan. 28, 2016

(30) Foreign Application Priority Data

Jul. 24, 2014 (JP) ..... 2014-150697

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04054* (2013.01)

(58) Field of Classification Search
CPC ..... G03G 15/043; G03G 15/4054
USPC ..... 399/4; 347/118
See application file for complete search history.

(56) References Cited

U.S. PATENT DOCUMENTS

2015/0035928 A1 2/2015 Nakamura et al.

FOREIGN PATENT DOCUMENTS

JP 2007-076031 3/2007

*Primary Examiner* — Quana M Grainger
(74) *Attorney, Agent, or Firm* — Harness, Dickey & Pierce, P.L.C.

(57) ABSTRACT

An optical-writing-head positioner includes a spacer disposed between a latent image bearer to bear a latent image and an optical writing head to expose the latent image bearer to light to form a latent image on a surface of the latent image bearer. The spacer positions the optical writing head with respect to the latent image bearer. The spacer includes plural contact faces with the latent image bearer in an axial direction of the latent image bearer. The plural contact faces include a contact face having an arc with a radius of curvature equal to or less than a radius of the latent image bearer and one of the a contact face having an arc with a radius of curvature greater than the radius of the latent image bearer and a flat contact face to contact the surface of the latent image bearer.

9 Claims, 13 Drawing Sheets

OPTICAL-WRITING-HEAD POSITIONER AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2014-150697, filed on Jul. 24, 2014, in the Japan Patent Office, the entire disclosure of which is incorporated by reference herein.

BACKGROUND

1. Technical Field

Embodiments of this disclosure relate to an optical-writing-head positioner to position an optical writing head with respect to a latent image bearer, and a process unit and an image forming apparatus, which include the optical-writing-head positioner.

2. Description of the Related Art

An image forming apparatus that uses an optical writing head formed of a light emitting diode (LED), organic electroluminescence (EL), or the like is known as an exposure device that exposes a latent image bearer such as a photoconductor drum to light and forms a latent image. Such an image forming apparatus is required to position the optical writing head with respect to the latent image bearer with a high degree of precision. Accordingly, an optical-writing-head positioner is generally provided to position the optical writing head with respect to the latent image bearer.

SUMMARY

In an aspect of the present disclosure, there is provided an optical-writing-head positioner including a spacer disposed between a latent image bearer to bear a latent image and an optical writing head to expose the latent image bearer to light to form a latent image on a surface of the latent image bearer. The spacer positions the optical writing head with respect to the latent image bearer. The spacer includes plural contact faces with the latent image bearer in an axial direction of the latent image bearer. The plural contact faces include a contact face having an arc with a radius of curvature equal to or less than a radius of the latent image bearer and one of the a contact face having an arc with a radius of curvature greater than the radius of the latent image bearer and a flat contact face to contact the surface of the latent image bearer.

In an aspect of the present disclosure, there is provided a process unit including the latent image bearer to form the latent image with exposure by the optical writing head and the optical-writing-head positioner to position the optical writing head with respect to the latent image bearer.

In an aspect of the present disclosure, there is provided an image forming apparatus including the optical-writing-head positioner.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
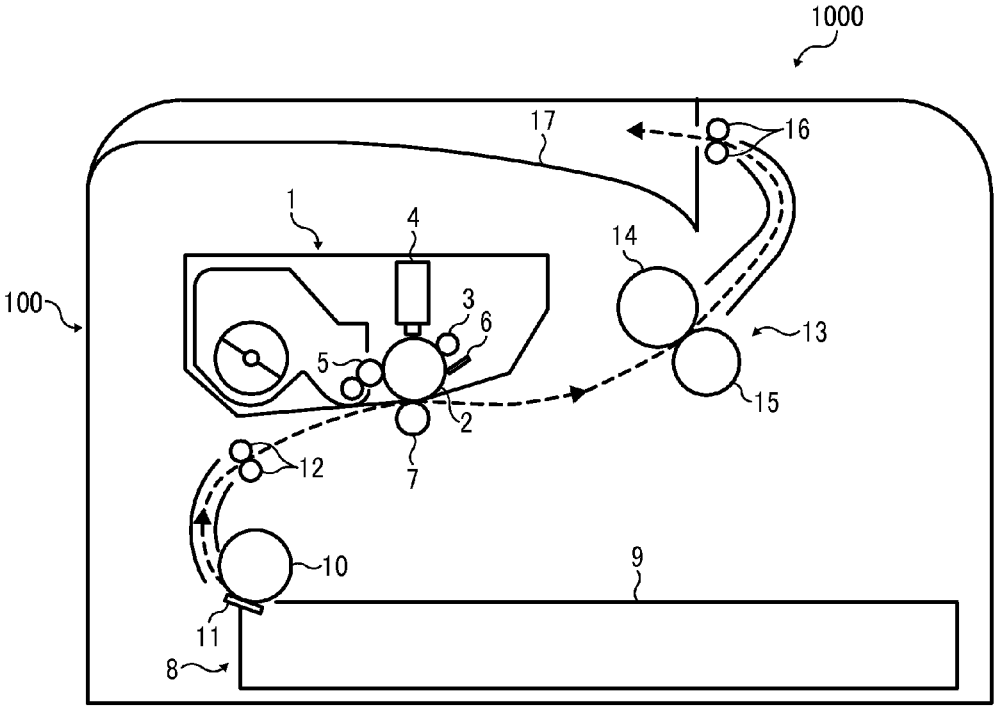
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

For example, an optical-writing-head positioner is proposed that uses a spacer provided between the latent image bearer and the optical writing head. Such a spacer is designed to have a smaller radius of curvature of a contact face with the latent image bearer than the radius of curvature of the latent image bearer and further have elasticity. Accordingly, the spacer is brought into intimate contact with the surface of the latent image bearer.

As described above, in a configuration of positioning an optical writing head with respect to a latent image bearer with a spacer, the spacer may have plural contact faces with the latent image bearer in consideration of a space and the arrangement of the spacer.

However, for such a spacer having plural contact faces, the contact faces may not closely contact the latent image bearer. As a result, the contact positions of the spacer with the latent image bearer may be unstable, and the position of the optical writing head with respect to the latent image bearer may be unstable.

As described below, according to at least one embodiment of the present disclosure, a spacer that position an optical writing head with respect to a latent image bearer includes, in an axial direction of the latent image bearer, plural contact faces to contact the latent image bearer. One of the plural contact faces has an arc with a radius of curvature equal to or less than the radius of the latent image bearer and accordingly contacts the latent image bearer at at least two points at both ends of the arc. Moreover, the other contact face has an arc with a larger radius of curvature than the radius of the latent image bearer, or is a flat contact face to contact the latent image bearer, and accordingly contacts the latent image bearer at one point. In this manner, the above three points determine points that contacts the latent image bearer on the contact faces. Hence, stability is established in the contact between the spacer and the latent image bearer, and in the position of the optical writing head with respect to the latent image bearer.

Description of Image Forming Apparatus

FIG. 1 is a schematic view of a configuration of an image forming apparatus 1000 according to an embodiment of the present disclosure. A description is given first of the entire configuration and operation of the image forming apparatus 1000 with reference to FIG. 1.

The image forming apparatus 1000 illustrated in FIG. 1 is a monochromatic image forming apparatus. A process unit 1 as an imaging unit is removably attached relative to an apparatus body (image forming apparatus body) 100 of the image forming apparatus 1000. The process unit 1 includes a photoconductor 2 being a drum-shaped rotary body as a latent image bearer that bears an image on its surface, a charging roller 3 as a charger that charges an outer circumferential surface of the photoconductor 2, an optical writing head 4 as an exposure unit that exposes the outer circumferential surface of the photoconductor 2 to light and forms an electrostatic latent image, a developing roller 5 as a developing unit that renders a latent image on the photoconductor 2 visible (makes the latent image a visible image), a cleaning blade 6 as a cleaner that cleans the surface of the photoconductor 2, and a neutralization device that removes static charge from the outer circumferential surface of the photoconductor 2.

The above-mentioned photoconductor 2, charging roller 3, optical writing head 4, developing roller 5, cleaning blade 6, and neutralization device are all integrally provided to a support of process unit 1. Hence, these components are replaceable at a time by attaching/detaching the process unit 1 to/from the apparatus body 100.

Moreover, a transfer roller 7 as a transferrer that transfers an image on the photoconductor 2 to a paper sheet is placed at a position facing the photoconductor 2. The transfer roller 7 is placed at a position contactable with the photoconductor 2 in a state where the process unit 1 is attached to the apparatus body 100. A transfer nip is formed with an abutment part of the transfer roller 7 and the photoconductor 2. Moreover, a power supply is connected to the transfer roller 7 to apply predetermined direct current (DC) and/or alternating current (AC) to the transfer roller 7.

A sheet feeder 8 is placed in a lower part of the apparatus body 100. The sheet feeder 8 includes a sheet feed tray 9 that stores sheets as recording media, a sheet feed roller 10 that feeds the sheets stored in the sheet feed tray 9, and a separation pad 11 that forms a nip in between the sheet feed roller 10 and the separation pad 11 and separates overlapping sheets. The sheets include cardboards, postcards, envelopes, plain papers, thin papers, coated papers (such as coat papers and art papers), and tracing papers. Moreover, OHP sheets, OHP films, fabric, and the like can also be used as recording media other than the sheets.

The sheet fed out from the sheet feeder 8 is transported along a conveyance path provided in the apparatus body 100 in a direction indicated by dotted arrows in the FIG. 1. In the conveyance path, a pair of timing rollers 12 that transports the sheet to the transfer nip at a proper transport timing is placed downstream of the sheet feed roller 10 in the sheet transport direction and upstream of the transfer roller 7 in the sheet transport direction.

Moreover, in the conveyance path, a fixing device 13 that fixes the image transferred onto the sheet is placed downstream of the transfer roller 7 in the sheet transport direction, and a pair of ejection rollers 16 that ejects the sheet to the outside of the apparatus is further placed downstream of the fixing device 13. The fixing device 13 includes a fixing roller 14 that is heated by a heat source such as a halogen lamp, and a pressure roller 15 that rotates while in contact with the fixing roller 14 at a predetermined pressure. A fixing nip is formed at a contact point of the rollers 14 and 15. Moreover, an ejection tray 17 on which the sheet ejected by the ejection rollers 16 to the outside of the apparatus is placed is provided in an upper part of the apparatus body 100.

Next, the imaging operation of the image forming apparatus 1000 according to the present embodiment is described with reference to FIG. 1. When the imaging operation starts, the photoconductor 2 is driven for rotation. The surface of the photoconductor 2 is uniformly charged by the charging roller 3 to a predetermined polarity. The optical writing head 4 irradiates the surface of the photoconductor 2 with light based on image information from a reading device, computer, or the like to form an electrostatic latent image on the charged surface of the photoconductor 2. Toner is supplied from the developing roller 5 to the electrostatic latent image so formed on the photoconductor 2. Accordingly, the electrostatic latent image is rendered visible (made a visible image) as a toner image.

Moreover, when the imaging operation starts, the sheet feed roller 10 starts driving for rotation, and sends out only the topmost sheet among the sheets stored in the sheet feed tray 9 to the conveyance path. The transport of the sheet sent out is temporarily stopped by the timing rollers 12. The timing rollers 12 start driving for rotation afterward at a predetermined timing. The sheet is transported to the transfer nip at the timing when the toner image on the photoconductor 2 reaches the transfer nip.

At this point in time, a transfer voltage of an opposite polarity to the toner charge polarity of the toner image on the photoconductor 2 is applied to the transfer roller 7. Consequently, a transfer electric field is formed at the transfer nip. The transfer electric field then makes the toner image on the photoconductor 2 to be transferred onto the sheet. The residual toner on the photoconductor 2, which could not be transferred onto the sheet and remains on the photoconductor 2, is removed by the cleaning blade 6. Static charge is removed afterward by the neutralization device from the surface of the photoconductor 2.

The sheet onto which the toner image has been transferred is transported to the fixing device 13, and passes through the fixing nip between the fixing roller 14 and the pressure roller 15 to be heated and pressurized. The toner image on the sheet is then fixed. The sheet is then ejected by the ejection rollers 16 to the outside of the apparatus to be placed on the ejection tray 17.

The optical writing head 4 uses an LED or organic EL device as a light emitting device. Such a light emitting device has a shallow (approximately 100 μm) depth of focus. Accordingly, the position of the optical writing head 4 with respect to the photoconductor 2 needs to be determined with a high degree of precision. Hence, the process unit 1 is provided with an optical-writing-head positioner that determines the position of the optical writing head 4 with respect to the photoconductor 2. The optical-writing-head positioner is described below.

Figure 2:
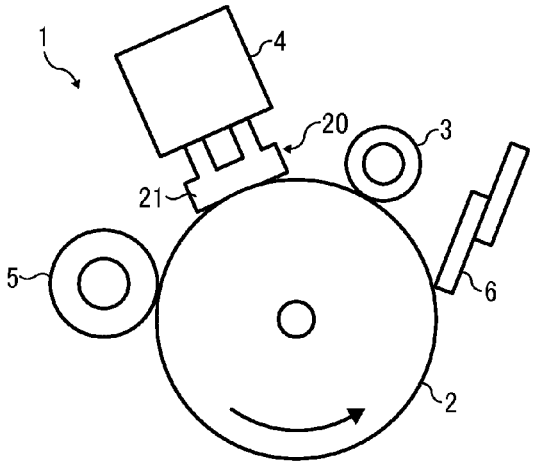
FIG. 2 is a schematic view of a configuration of a process unit according to an embodiment of the present disclosure.

Description of Optical-Writing-Head Positioner of First Embodiment of Present Disclosure As illustrated in FIG. 2, an optical-writing-head positioner 20 includes spacers 21 provided between a photoconductor 2 and an optical writing head 4 to contact the photoconductor 2 and the optical writing head 4. The spacer 21 functions as a stopper that regulates the distance between the photoconductor 2 and the optical writing head 4, and plays a role in deciding the interval between them.

Figure 3:
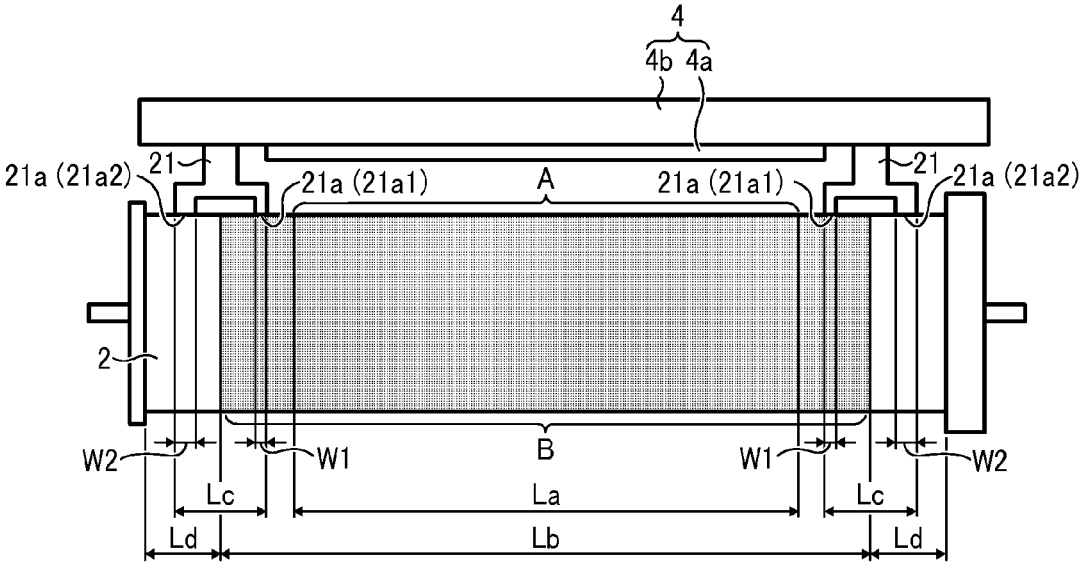
FIG. 3 is a schematic view of a configuration of an optical-writing-head positioner according to an embodiment of the present disclosure.

As illustrated in FIG. 3, the optical writing head 4 is placed extending in the axial direction (main scanning direction) of the photoconductor 2. Moreover, the optical writing head 4 includes a lens array 4*a*, a light emitting board, a head frame 4*b* as a holder that holds the lens array 4*a* and the light emitting board. The spacers 21 are respectively placed on both ends in the longitudinal direction of the optical writing head 4 or the axial direction of the photoconductor 2, and are respectively in contact with the head frame 4*b* of the optical writing head 4 and the photoconductor 2. The spacers 21 have a configuration to receive a load in a direction from the optical writing head 4 to the photoconductor 2 by a biasing member such as a coil spring in a state where the spacers 21 are in contact with both of the photoconductor 2 and the optical writing head 4.

Suppose a maximum image formation area in which a toner image is formed on the photoconductor 2 is A. A contact face 21*a* of the spacer 21 with the photoconductor 2 is placed outside the maximum image formation area A to reduce the wearing away of the photoconductor 2 in the maximum image formation area A.

Moreover, in the present embodiment, each spacer 21 is in contact with the photoconductor 2 in two places that are away from each other in the axial direction of the photoconductor 2. In other words, each spacer 21 has two contact faces 21*a* that contact the photoconductor 2 at positions away from each other. The two contact faces 21*a* are placed one to either side of a boundary of a cleaning area B (a cleaning area edge) which a cleaning blade 6 contacts on the photoconductor 2, while avoiding the boundary.

In this manner, the contact faces 21*a* are placed on both sides of the boundary of the cleaning area B to prevent the entry of streaked residual toner caused in the vicinity of the boundary of the cleaning area B between the photoconductor 2 and the spacer 21 (the contact face 21*a*), which prevents a reduction in the positioning accuracy of the optical writing head 4 with respect to the photoconductor 2 due to the entry of residual toner between the photoconductor 2 and the spacer 21.

Figure 14:
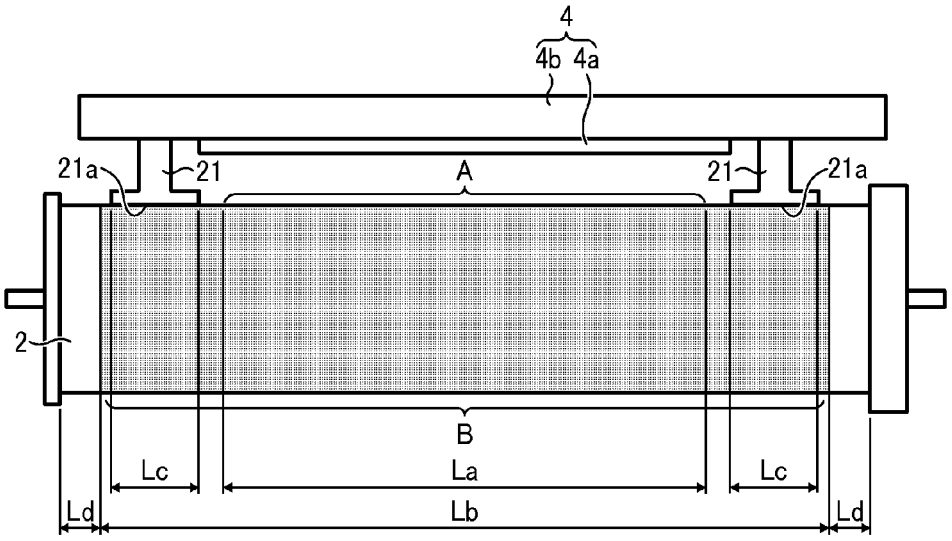
FIG. 14 is a schematic view of a configuration of another optical-writing-head positioner according to an embodiment of the present disclosure.

Moreover, in terms of the placement of the contact face 21*a* of the spacer 21 avoiding the boundary of the cleaning area B, apart from the above placement of the present embodiment, it is also considered to, for example, place the contact face 21*a* inside the boundary of the cleaning area B without dividing the contact face 21*a* into two as illustrated in FIG. 14. In this case, however, a length Lb of the cleaning area B in the photoconductor axial direction is longer than a total of a length La of the maximum image formation area A in the photoconductor axial direction and lengths Lc of the contact faces 21*a* of both of the spacers 21 in the photoconductor axial direction (Lb>La+2Lc). As a result, the length of the cleaning blade 6 is increased.

Moreover, if the contact face 21*a* of the spacer 21 is placed outside the boundary of the cleaning area B, a length Ld of the photoconductor 2 outside the cleaning area B in the axial direction is required to be longer than the length Lc of the contact face 21*a* of the spacer 21 in the photoconductor axial direction. Therefore, in this case, the total length of the photoconductor 2 in the axial direction is increased.

As described above, when the contact face 21*a* is placed inside or outside the cleaning area B without being divided into two, the length of the cleaning blade 6 and the total length of the photoconductor 2 are increased. Therefore, both cases are disadvantageous to size reduction.

In contrast, when the contact face 21*a* is divided and placed on both sides of the boundary of the cleaning area B as in the present embodiment, even if the length of the spacer 21 in the photoconductor axial direction is the same as the example illustrated in FIG. 14, the length of the cleaning blade 6 and the total length of the photoconductor 2 can be reduced. Consequently, in the present embodiment, it is possible to achieve both the prevention of a reduction in the positioning accuracy of the optical writing head 4 due to the entry of the residual toner between the photoconductor 2 and the spacer 21, and a reduction in the size of the apparatus. The number of contact faces 21*a*, which contact the photoconductor 2, of one spacer 21 may be three or more. Also in that case, at least one contact face 21*a* is placed on each side of the boundary of the cleaning area B across the boundary. Accordingly, similar effects to the above effects can be obtained.

Figure 15A:
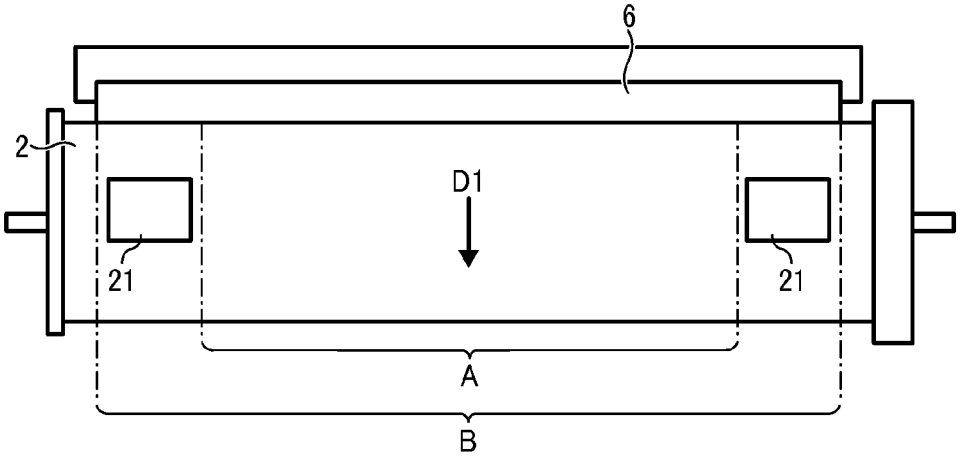
FIGS. 15A to 15E are diagrams illustrating how foreign substances adhere to the surface of the photoconductor according to an embodiment of the present disclosure.

Moreover, FIGS. 15A to 15E are diagrams of the configuration illustrated in the above FIG. 14 when viewed from the optical writing head side. As illustrated in FIG. 15A, also in this example, the cleaning blade 6 as a cleaner is provided in such a manner as to contact the photoconductor 2 as in the present embodiment. Therefore, the residual toner and the like that remain on the photoconductor 2 after the transfer of an image are basically removed by the cleaning blade 6 from the photoconductor 2. However, a free substance such as silica that has come off the toner has a size of approximately several nanometers, which is especially small. Accordingly, the free substance may not be removed and may pass the cleaning blade 6. The passed free substance remains on the photoconductor 2 to become a cleaning residue.

Figure 15B:
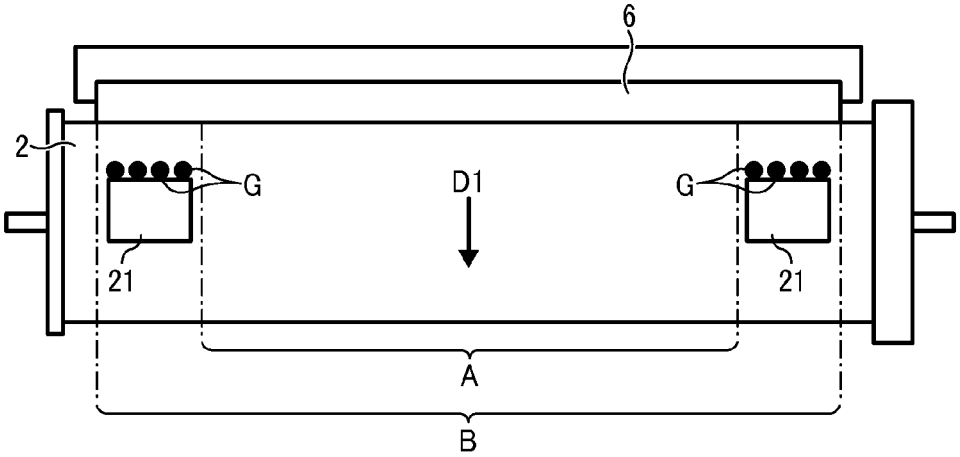
Figure 15C:
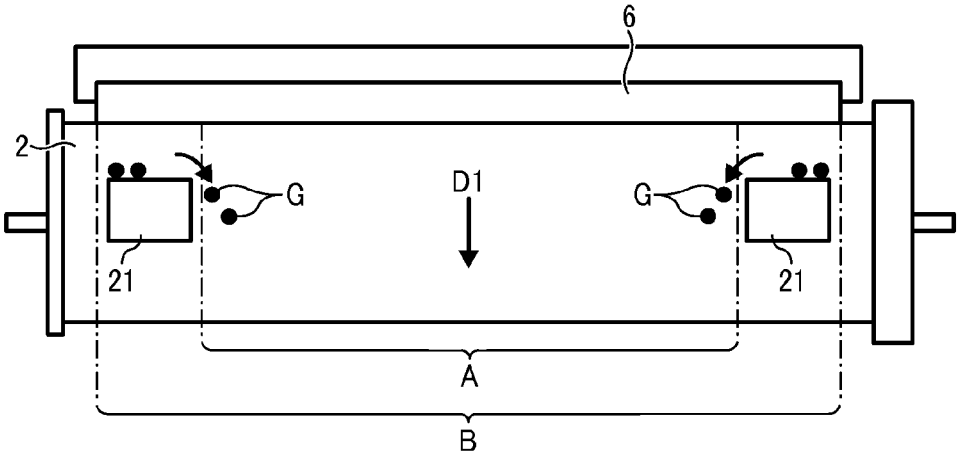
Figure 15D:
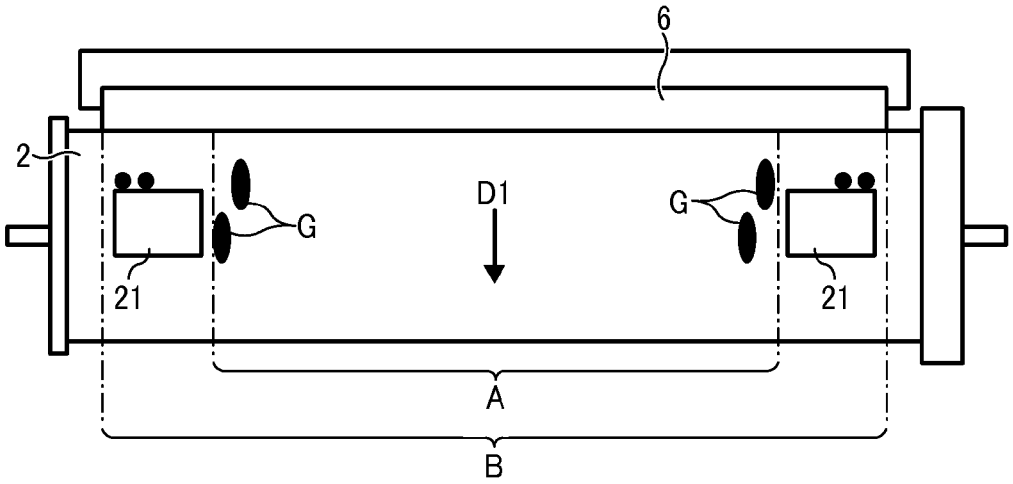
Figure 15E:
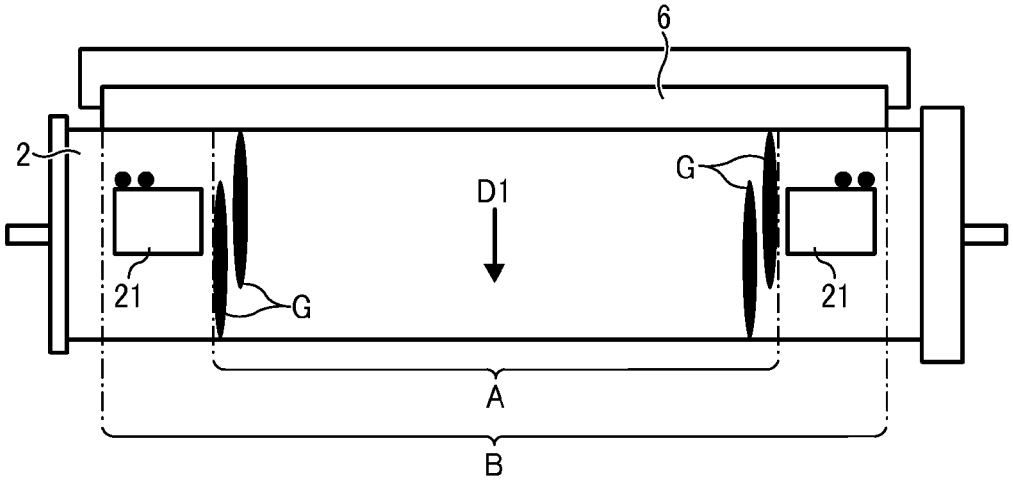

As illustrated in FIG. 15B, cleaning residues G that have passed the cleaning blade 6 contact the spacers 21 placed downstream of the cleaning blade 6 in the photoconductor rotation direction (latent image bearer rotation direction) D1, and deposit upstream in the photoconduction rotation direction D1. As illustrated in FIG. 15C, part of the deposited cleaning residues G move into the maximum image formation area A afterward at a certain timing due to vibrations or the like. As illustrated in FIG. 15D, the cleaning residues G that have moved into the maximum image formation area A are then pressed against the photoconductor 2 by the developing roller 5 and the cleaning blade 6 to adhere onto the photoconductor 2. Furthermore, as illustrated in FIG. 15E, the adhered cleaning residues G act as starting points and the residual toner and the like attach thereto. When the adhered substances become bigger, it may cause image failure.

In order to deal with such a problem, a width W1, in the photoconductor axial direction, of a contact face 21*a*1 placed inside the cleaning area B (hereinafter referred to as the "inner photoconductor contact face") among the two contact faces 21*a* of the spacer 21 that contact the photoconductor 2 is made smaller than a width W2, in the photoconductor axial direction, of a contact face 21*a*2 placed outside the cleaning area B (hereinafter referred to as the "outer photoconductor contact face"), as illustrated in FIG. 3 in the present embodiment. With such a configuration, even if free substances that have come off the toner pass the cleaning blade 6, it is possible to prevent the deposition of the cleaning residues on the inner photoconductor contact face 21*a*1. Consequently, the occasions that the deposited cleaning residues move into the maximum image formation area A and adhere, or its amount, can be reduced. Accordingly, the occurrence of image failure due to the adhesion of the cleaning residues can be prevented.

Figure 4A:
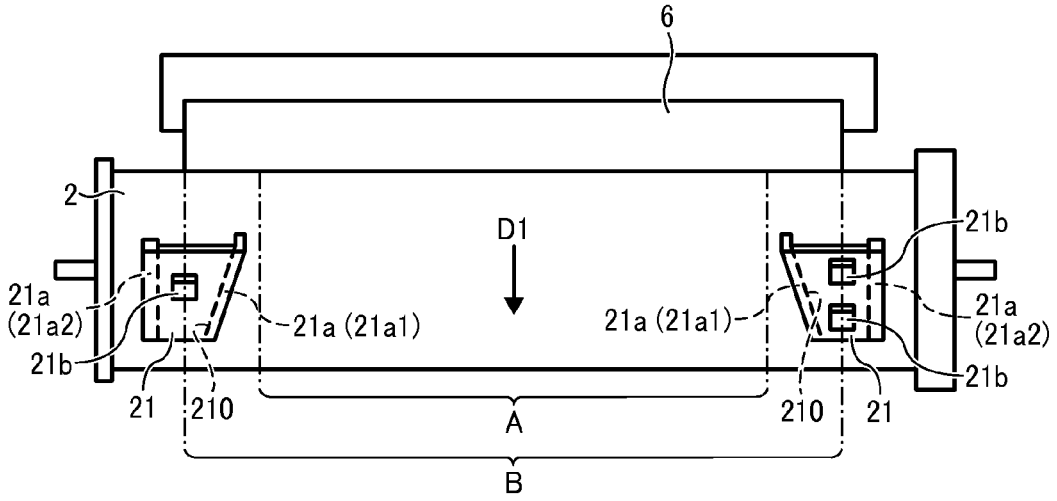
FIGS. 4A and 4B are schematic views of the configuration of the optical-writing-head positioner illustrated in FIG. 3.
Figure 4B:
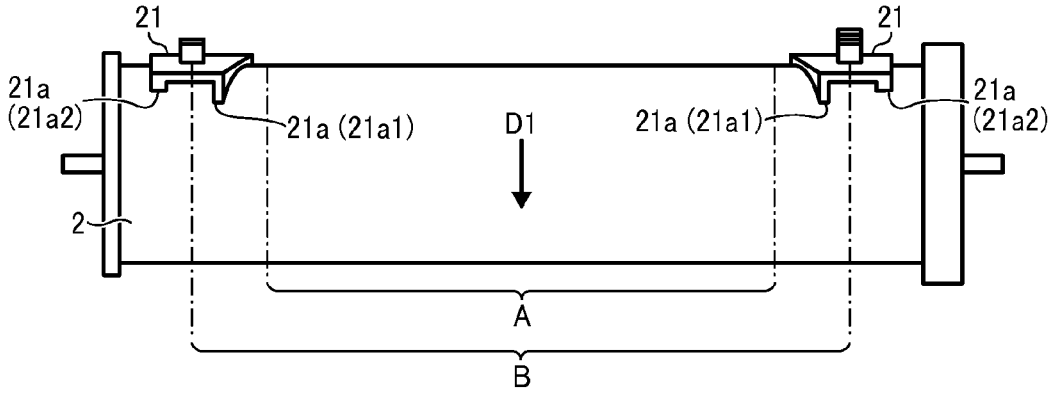

Furthermore, as illustrated in FIGS. 4A and 4B, the inner photoconductor contact face 21*a*1 is inclined with respect to the photoconductor axial direction in the present embodiment. Specifically, the inner photoconductor contact face 21*a*1 is inclined from the upstream side toward the downstream side in the photoconductor rotation direction D1 in such a manner as to be increasingly away from the maximum image formation area A. Consequently, the cleaning residues can be moved along the slope of the inner photoconductor contact face 21*a*1 and away from the maximum image formation area A. Accordingly, the adhesion of the cleaning residues to the maximum image formation area A can be efficiently prevented. In the present embodiment, the entire inner photoconductor contact face 21*a*1 is inclined. However, only an edge 210 of the inner photoconductor contact face 21*a*1, the edge 210 facing upward in the photoconductor rotation direction D1 (hereinafter referred to as the "upstream edge") in which the cleaning residues especially deposit, may be inclined.

FIGS. 5A to 5D are diagrams illustrating a configuration of the spacer 21 according to the present embodiment. The configuration of the spacer 21 is described in detail hereinafter with reference to FIGS. 5A to 5D. Both of the spacers 21 have a symmetrical shape to each other and a substantially similar configuration, except the respect that one (the right spacer 21 in FIGS. 4A and 4B) of the spacers 21 has two contact faces 21*b* that contact the optical writing head 4 and the other (the left spacer 21 in FIGS. 4A and 4B) has one contact face 21*b*. Therefore, in the following description, the spacer 21 having two contact faces 21*b* with the optical writing head 4 is described as an example.

The spacer 21 includes a plate 25, two legs 24 provided on a photoconductor 2 side (a lower surface in FIG. 5A) of the plate 25, and two pillars 26 provided on an optical writing head 4 side (an upper surface in FIG. 5A) of the plate 25. The plate 25, the legs 24, and the pillars 26 may be integrally molded, or molded as separate bodies. The legs 24 are placed with a space therebetween on both ends in the width direction of the plate 25 corresponding to the axial direction of the photoconductor 2. On the other hand, the pillars 26 are placed in the middle in the width direction of the plate 25, where the legs 24 are not provided. Moreover, the pillars 26 are placed with a space therebetween in the direction perpendicular to the width direction of the plate 25, in other words, the circumferential direction of the photoconductor 2.

The pillars 26 contact the optical writing head 4 in a state where the spacer 21 is placed between the optical writing head 4 and the photoconductor 2. Therefore, the pillars 26 each include the contact face 21*b* that contacts the optical writing head 4. The pillars 26 may be fixed to the optical writing head 4, or may separatably contact the optical writing head 4.

On the other hand, the legs 24 contact the photoconductor 2 in a state where the spacer 21 is placed between the optical writing head 4 and the photoconductor 2. The contact face 21*a* of each leg 24 with the photoconductor 2 is formed into an arc along the shape of the surface of the photoconductor 2.

The spacer 21 is pressed toward the photoconductor 2 with the load of the optical writing head 4 placed above the spacer 21. The shape of the surface of the contact face 21*a* deforms into a shape along the shape of the surface of the photoconductor 2. The contact face 21*a* then comes into intimate contact with the surface of the photoconductor 2. Consequently, it is possible to prevent the entry of a foreign substance between the spacer 21 and the photoconductor 2 and maintain the position of the optical writing head 4 with respect to the photoconductor 2 with a high degree of precision.

The radius of curvature of the arc of the inner photoconductor contact face 21*a*1 is set to the radius of the photoconductor 2 or less. The radius of curvature of the arc of the outer photoconductor contact face 21*a*2 is set to be larger than the photoconductor 2. The reason why they are set in this manner is shown below.

Figure 16A:
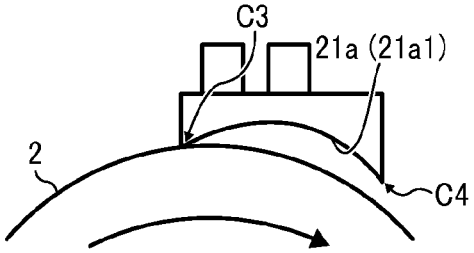
FIGS. 16A to 16C are schematic views of a configuration of another optical-writing-head positioner according to an embodiment of the present disclosure.
Figure 16B:
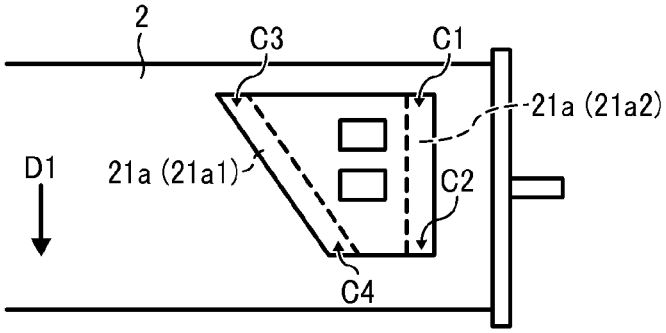
Figure 16C:
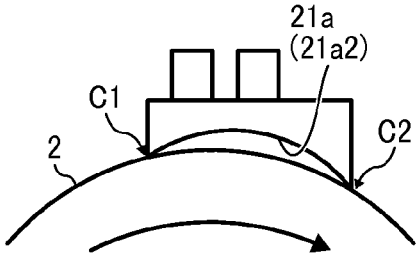

FIGS. 16A to 16C illustrate a case where the curvature radii of the arcs of both the inner photoconductor contact face 21*a*1 and the outer photoconductor contact face 21*a*2 are made smaller than the radius of the photoconductor 2. FIG. 16B is a diagram when viewed from above the spacer 21. FIGS. 16A and 16C are schematic views of the contact faces 21*a* of the spacer 21. FIGS. 6A to 6C, 7A to 7C, and 17A to 17C described below also illustrate a similar configuration.

If the curvature radii of the arcs of the contact faces 21*a* are made smaller than the radius of the photoconductor 2, each arc has, at both ends, points that contact the photoconductor 2. The spacer 21 has four contact points (C1, C2, C3, and C4) in total.

However, in cases such as where there is a predetermined error in the curvatures of the arcs, which contact the photoconductor 2, of the two contact faces 21*a*, and axes in the contact direction of the two contact faces 21*a* with respect to the surface of the photoconductor 2 are displaced, these four points do not contact the photoconductor 2 simultaneously. Consequently, at the point in time when three points out of four come into contact with the photoconductor 2, the position of the spacer 21 with respect to the photoconductor 2 may be determined and the remaining one point (C4 in FIGS. 16A and 16B) may be in non-contact with the photoconductor 2.

In this case, the position of a corner, which has the one non-contact point, of the spacer 21 is not fixed with respect to the photoconductor 2, and the corner becomes unstable. Moreover, the point to become non-contact also changes as occasion arises depending on how the spacer 21 contacts the photoconductor 2.

From the above respects, in the configuration in FIGS. 16A to 16C, there arises a problem in that the distance of the optical writing head 4 to the photoconductor 2 is not stable.

Figure 17A:
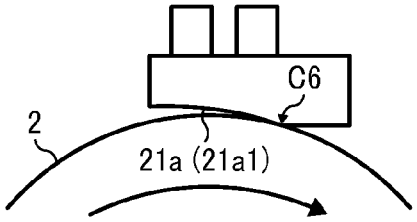
FIGS. 17A to 17C are schematic views of a configuration of another optical-writing-head positioner according to an embodiment of the present disclosure.
Figure 17B:
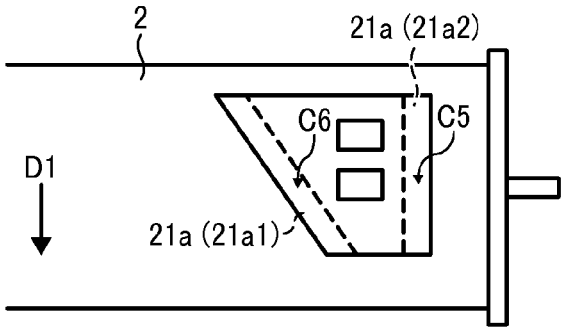
Figure 17C:
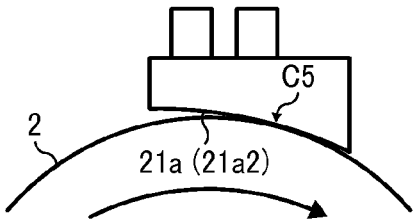

As an opposite configuration, a case is considered in which the curvature radii of the arcs of both the inner photoconductor contact face 21*a*1 and the outer photoconductor contact face 21*a*2 are made larger than the radius of the photoconductor 2 as illustrated in FIGS. 17A to 17C.

If the curvature radii of the arcs are made larger than the radius of the photoconductor 2, each contact face 21*a* contacts the photoconductor 2 at one point, and the spacer 21 has two contact points (C5 and C6).

The point where each contact face 21*a* contacts the photoconductor 2 is fixed at one point. Accordingly, there is hardly a problem in that the contact point depends on the time. However, each contact face 21*a* contacts the photoconductor 2 only at one point, and both ends of the contact face are not in contact with the photoconductor 2. Accordingly, the attitude of the spacer 21 with respect to the photoconductor 2 is not stable and the distance of the optical writing head 4 to the photoconductor 2 is not stable.

Moreover, if it is attempted to bring the contact faces 21*a* into sufficiently intimate contact with the photoconductor 2, a large load is required to be applied to the photoconductor 2 side of the spacer 21. However, there arises another problem in that the friction between the photoconductor 2 and the spacer 21 is increased due to the large load to promote the wearing away of both spacers.

As described above, in any configuration, the distance of the optical writing head 4 to the photoconductor 2 cannot be made stable, and the function of the spacer 21 as a positioner cannot be fully achieved.

Hence, in the configuration of the present embodiment, the radius of curvature of the arc of the inner photoconductor contact face 21*a*1 is set to be equal to or less than the radius of the photoconductor 2, and the radius of curvature of the arc of the outer photoconductor contact face 21*a*2 is set to be larger than the radius of the photoconductor 2.

Figure 6A:
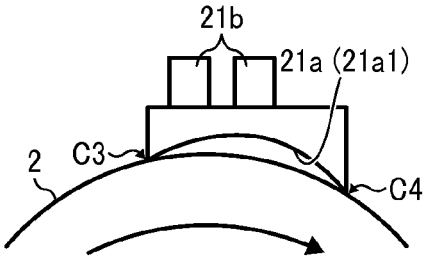
FIGS. 6A to 6C are schematic views of a configuration of an optical-writing-head positioner according to a first embodiment of the present disclosure.
Figure 6B:
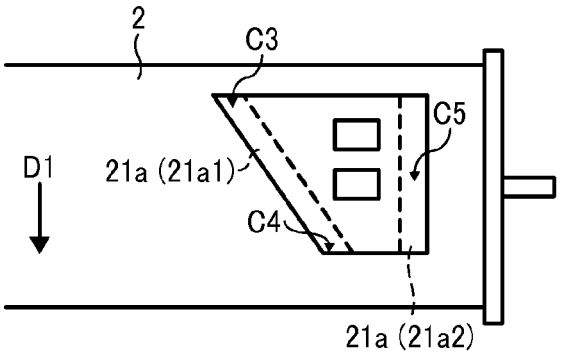
Figure 6C:
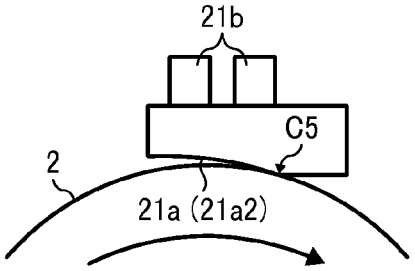

Consequently, as illustrated in FIGS. 6A to 6C, the spacer 21 has three contact points (C3, C4, and C5) with the photoconductor 2. Since the three contact points are predetermined, there is hardly a problem in that the contact points are not fixed and the distance of the optical writing head 4 to the photoconductor 2 is not stable like the configuration illustrated in FIGS. 16A to 16C.

Figure 7A:
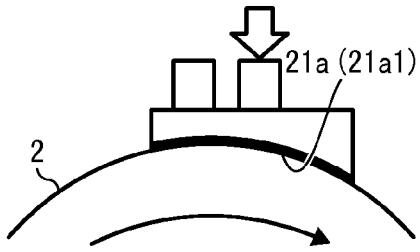
FIGS. 7A to 7C are schematic views of the configuration of the optical-writing-head positioner according to the first embodiment of the present disclosure.
Figure 7B:
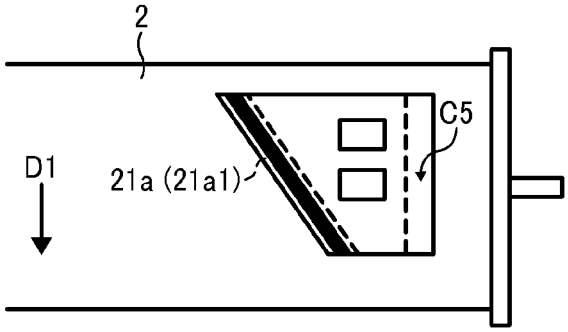
Figure 7C:
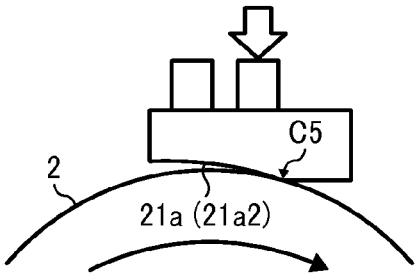

The contact face 21*a*1 that contacts the photoconductor 2 at two points is pressed toward the photoconductor 2 by the load of the optical writing head 4 placed above the spacer 21, deforms along the shape of the surface of the photoconductor 2 as illustrated in FIGS. 7A to 7C, and comes into intimate contact with the surface of the photoconductor 2.

At this point in time, the outer photoconductor contact face 21*a*2 contacts the photoconductor 2 at the contact point C5. The entire surface of the outer photoconductor contact face 21*a*2 is not brought into intimate contact with the photoconductor 2. The contact face 21*a* to be brought into intimate contact with the photoconductor 2 is only the inner photoconductor contact face 21*a*1. Therefore, the load to be applied to the spacer 21 is reduced as compared to the configuration illustrated in FIGS. 16A to 16C. The wearing away of the spacer 21 and the photoconductor 2 can be reduced.

The inner photoconductor contact face 21*a*1 is brought into contact at two points, and the outer photoconductor contact face 21*a*2 at one point. Therefore, an inner portion of the contact face 21*a* in the axial direction of the photoconductor 2 where more cleaning residues flow can be brought into intimate contact with the photoconductor 2, and the entry of the cleaning residues between the contact face 21*a* and the photoconductor 2 can be efficiently prevented. Consequently, the position of the optical writing head 4 with respect to the photoconductor 2 can be maintained with a high degree of precision.

The configuration is not limited to the above configuration but may be one that the radius of curvature of the arc of the outer photoconductor contact face 21*a*2 is set to be equal to or less than the radius of the photoconductor 2, the radius of curvature of the arc of the inner photoconductor contact face 21*a*1 is set to be larger than the radius of the photoconductor 2, the outer photoconductor contact face 21*a*2 contacts the photoconductor 2 at two points, and the inner photoconductor contact face 21*a*1 contacts the photoconductor 2 at one point.

As described above, with the configuration of the present embodiment, as compared to the configurations illustrated in FIGS. 16A to 16C and 17A to 17C, the distance of the optical writing head 4 to the photoconductor 2 can be stabilized so that the wearing away of the spacer 21 and the photoconductor 2 is not promoted due to an excessive load.

Moreover, each leg 24 is formed in a rib portion extending over the photoconductor rotation direction D1. Hence, each leg 24 is easy to elastically deform along the surface of the photoconductor 2, resists the creation of a gap in between the photoconductor 2 and the leg, and can bring the spacer 21 into intimate contact with the photoconductor 2 with a smaller load.

Moreover, out of the two legs 24, the leg 24 having the inner photoconductor contact face 21*a*1 inclined with respect to the photoconductor rotation direction D1 is smaller in width than the other leg 24, and accordingly is easier to elastically deform and come into intimate contact with the photoconductor 2. In addition, a leading end width t1 of the leg 24, which is the width of the inner photoconductor contact face 21*a*1, is formed smaller than a width t2 at the base {see FIG. 5D}, and accordingly is easier to elastically deform than a leg 24 having the leading end width t1 equal to the width t2 at the base. In this manner, especially the leg 24 having the inner photoconductor contact face 21*a*1 is easy to elastically deform. Therefore, it becomes difficult for a gap to be created in between the photoconductor 2 and the leg, and the load to be applied to the spacer 21 is also reduced. Therefore, the cleaning residues reduce their tendency to pass between the contact faces of the leg 24 and the photoconductor 2, and move along the slope of the leg 24. Hence, the adhesion of the cleaning residues to the maximum image formation area A can be prevented.

In the present disclosure, surface roughness Ra of the inner photoconductor contact face 21*a*1 is set within a range of 0.3 to 5.0 [$10^{-6}$ m]. Setting up in this manner makes silica and the like included in the toner easy to be caught on the uneven surface of the inner photoconductor contact face 21*a*1 and build up. Consequently, the silica and the like included in the toner flowing over the surface of the photoconductor 2 coat the surface of the inner photoconductor contact face 21*a*1 to fill the gap between the inner photoconductor contact face 21*a*1 and the photoconductor 2. Accordingly, the cleaning residues become difficult to pass through the gap.

At a surface roughness Ra of 0.3 [$10^{-6}$ m] or lower, the silica and the like included in the toner cannot remain on the surface. Moreover, at Ra 5.0 [$10^{-6}$ m] or more, the unevenness is increased too much. Therefore, the gap between the photoconductor 2 and the inner photoconductor contact face 21*a*1 is increased and conversely, it becomes easier for the toner to pass therebetween. From the above reasons, the surface roughness Ra of the inner photoconductor contact face 21*a*1 is set within the range of 0.3 to 5.0 [$10^{-6}$ m].

The surface roughness Ra of the inner photoconductor contact face 21*a*1 to come into intimate contact with the photoconductor 2 is set within the range of 0.3 to 5.0 [$10^{-6}$ m] to fill the gap between the inner photoconductor contact face 21*a*1 and the photoconductor 2 by the above-mentioned coating action. However, the surface roughness of the outer photoconductor contact face 21*a*2 may be set similarly.

Figure 5A:
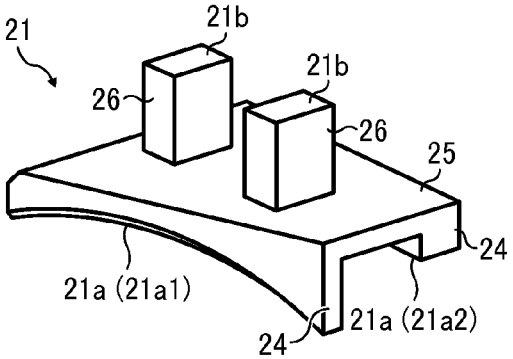
FIGS. 5A to 5D are diagrams illustrating a configuration of a spacer according to an embodiment of the present disclosure.
Figure 5B:
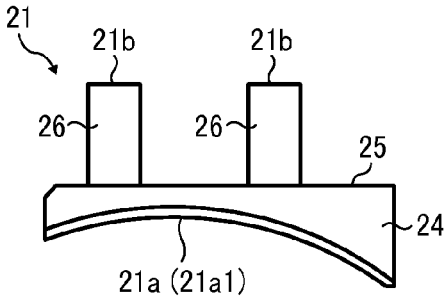
Figure 5C:
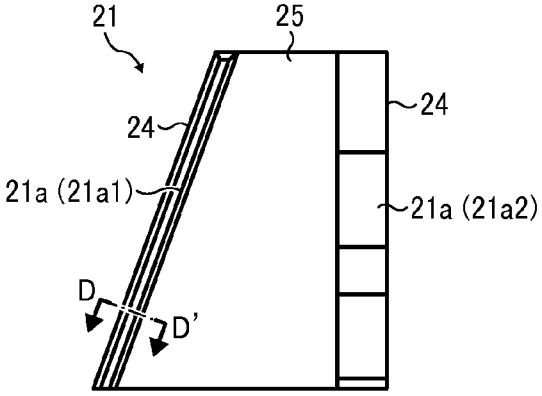
Figure 5D:
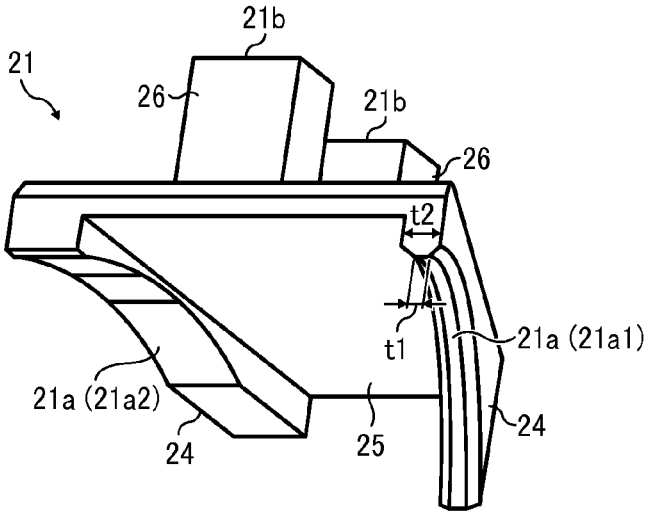
Figure 8:
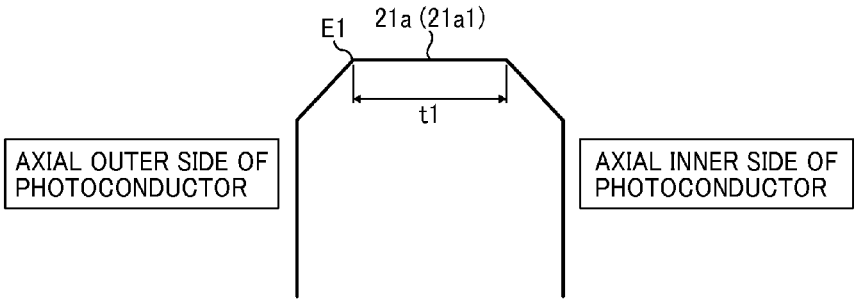
FIG. 8 is an enlarged view of the vicinity of an inner photoconductor contact face according to an embodiment of the present disclosure.

FIG. 8 illustrates a cross-sectional view cut along sectional line D-D' of FIG. 5C. In the present disclosure, among edges, which contact the photoconductor 2, of the leg 24 having the inner photoconductor contact face 21*a*1, an outer edge E1 of the spacer 21 is R-chamfered at R 0.03 [mm] or less.

Figure 9:
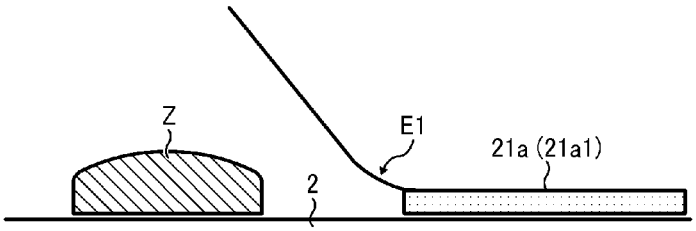
FIG. 9 is an enlarged view of the vicinity of a contact face and a photoconductor according to an embodiment of the present disclosure.

The size of the round of the edge E1 is set to 0.03 [mm] or less. Accordingly, an adhered substance Z (illustrated in FIG. 9) on the surface of the photoconductor 2 comes into contact with the edge by the rotation of the photoconductor 2 in the axial direction to enable the edge to scrape away the adhered substance Z.

The edge E1 is not only R-chamfered at R 0.03 [mm] or less but may be C-chamfered at C 0.03 [mm] or less, or form a right angle.

Settings of Leading End Width T1 of Leg 24 and Load on Spacer 21

Figure 10:
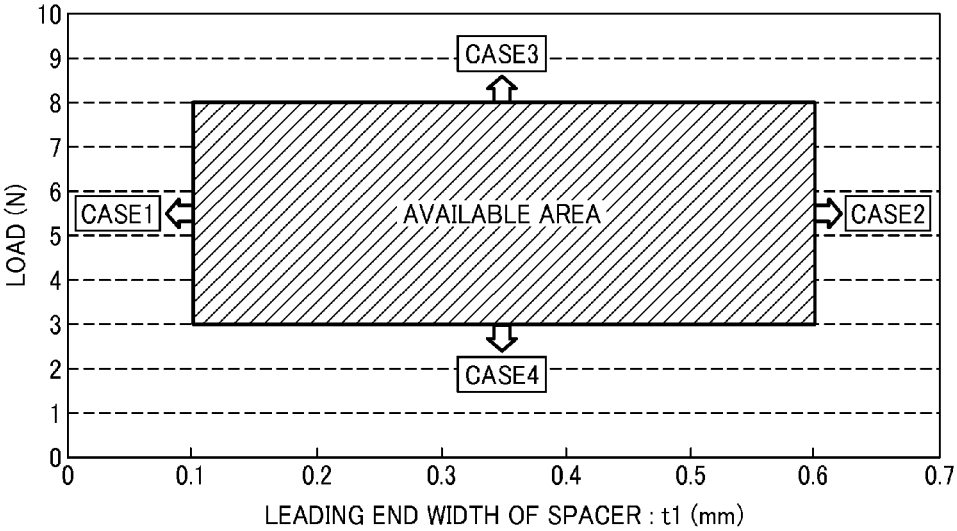
FIG. 10 is a diagram illustrating the relationship between the leading end width of and the load on the spacer according to an embodiment of the present disclosure.

FIG. 10 is a diagram illustrating experiment results that the conditions of the leading end width t1 of the leg 24, which is the width of the inner photoconductor contact face 21*a*1, and the load applied by the optical writing head 4 to the spacer 21 were changed to check changes in the removal effect of the cleaning residues and the durability of the photoconductor 2 and the spacer 21.

The smaller the leading end width t1 of the leg 24, which is the width of the inner photoconductor contact face 21*a*1, the easier the inner photoconductor contact face 21*a*1 becomes to contact the photoconductor 2. However, when the leading end width t1 is made too small, it becomes difficult to produce the component. Moreover, when the leading end width t1 is made too small, there arise problems such as that a leading end portion of the leg 24 having the inner photoconductor contact face 21*a*1 becomes chipped due to the cleaning residue on the photoconductor 2. If the leading end portion of the leg 24 becomes chipped, the cleaning residues on the photoconductor 2 slip away after the chipping and the cleaning residues cannot be suitably removed (case 1 in FIG. 10). To prevent the occurrence of such a chipping of the leading end portion, it is desirable to set the leading end width t1 to 0.1 [mm] or more as illustrated in FIG. 10.

On the other hand, if the leading end width t1 of the leg 24, which is the width of the inner photoconductor contact face 21*a*1, is increased, it becomes easy to produce the component. However, the inner photoconductor contact face 21*a*1 becomes difficult to contact the photoconductor 2. As a result, a gap is created between the inner photoconductor contact face 21*a*1 and the photoconductor 2. Therefore, a slipping away of the cleaning residues on the photoconductor 2 occurs, and the cleaning residues cannot be suitably removed (case 2 in FIG. 10). To prevent such creation of a gap between the inner photoconductor contact face 21*a*1 and the photoconductor 2, it is desirable to set the leading end width t1 to 0.6 [mm] or less as illustrated in FIG. 10.

Moreover, the larger the load applied by the optical writing head 4 to the spacer 21, the easier the inner photoconductor contact face 21*a*1 becomes to contact the photoconductor 2. However, if the load is made too larger, the wearing away of the photoconductor 2 and the spacer 21 is promoted. As a result, the distance between the optical writing head 4 and the photoconductor 2 is reduced too much, and focus is blurred in the optical writing head 4 (case 3 in FIG. 10). To reduce such a wearing away of the photoconductor 2 and the spacer 21, it is desirable to set the load on the spacer 21 to 8 [N] or less as illustrated in FIG. 10.

On the other hand, if the load on the spacer 21 is reduced, the wearing away of the photoconductor 2 and the spacer 21 can be reduced. However, the inner photoconductor contact face 21*a*1 becomes difficult to contact the photoconductor 2. As a result, a gap is created between the inner photoconductor contact face 21*a*1 and the photoconductor 2. Accordingly, the slipping away of the cleaning residues on the photoconductor 2 occurs, and the cleaning residues cannot be suitably removed (case 4 in FIG. 10). To prevent such creation of a gap between the inner photoconductor contact face 21*a*1 and the photoconductor 2, it is desirable to set the load on the spacer 21 to 3 [N] or more as illustrated in FIG. 10.

From the above results, in the configuration of the present embodiment, it can be said that it is desirable to set the leading end width t1 of the leg 24, which is the width of the inner photoconductor contact face 21*a*1, within a range of 0.1 [mm] or more to 0.6 [mm] or less, and the load on the spacer 21 within a range of 3 [N] or more to 8 [N] or less.

Figure 11A:
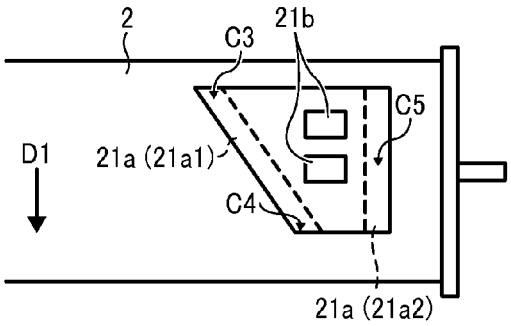
FIGS. 11A and 11B are schematic views of a configuration of an optical-writing-head positioner according to a second embodiment of the present disclosure.
Figure 11B:
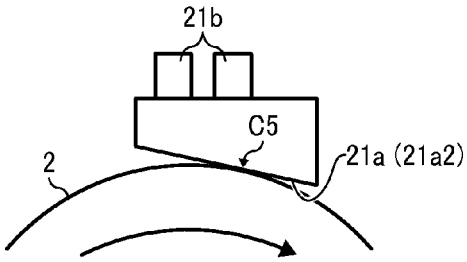
Figure 12A:
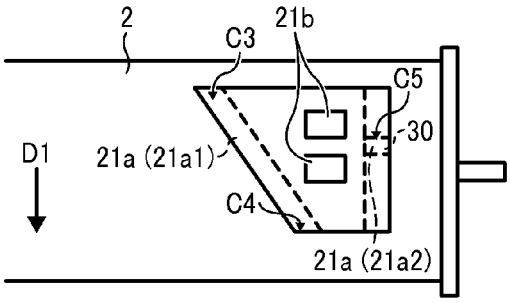
FIGS. 12A and 12B are schematic views of a configuration of an optical-writing-head positioner according to a third embodiment of the present disclosure.
Figure 12B:
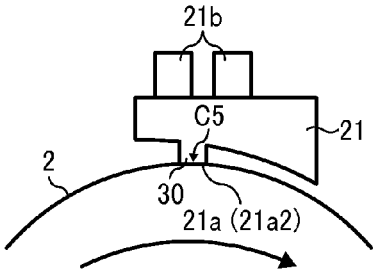

Description of Optical-Writing-Head Positioner of Second Embodiment of the Present Disclosure FIGS. 11A and 11B illustrate a spacer 21 in an optical-writing-head positioner of a second embodiment. FIG. 11A is a diagram when viewed from above the spacer 21. FIG. 11B is a schematic view of a contact face 21*a* of the right part, in the axial direction of a photoconductor 2, of the spacer 21. FIGS. 12A and 12B described below also illustrate a similar configuration. In the second embodiment of the present disclosure, an outer photoconductor contact face 21*a*2 does not have an arc shape, and is formed into a flat contact face. The outer photoconductor contact face 21*a*2 is made flat to bring the outer photoconductor contact face 21*a*2 into contact with the photoconductor 2 in such a manner as that the outer photoconductor contact face 21*a*2 contacts the surface of the photoconductor 2.

The outer photoconductor contact face 21*a*2 is made flat so that the production of the spacer 21 is simplified to enable a reduction in production cost. Moreover, the precision of the component can be improved, and the distance of an optical writing head 4 to the photoconductor 2 is further stabilized. It is similar to the first embodiment in the respect that the spacer 21 contacts the photoconductor 2 at three points.

Description of Optical-Writing-Head Positioner of Third Embodiment of the Present Disclosure An optical-writing-head positioner of a third embodiment of the present disclosure includes a protrusion 30 protruding toward a photoconductor 2 with respect to its surrounding, in an outer leg 24 of the spacer 21 in the axial direction of the photoconductor 2 as illustrated in FIGS. 12A and 12B. The protrusion 30 has an outer photoconductor contact face 21*a*2 being a flat contact face that faces the photoconductor 2 and contacts the photoconductor 2.

An inner photoconductor contact face 21*a*1 of an inner leg 24 in the axial direction of the photoconductor 2 has an arc shape with a radius of curvature equal to or less than the radius of the photoconductor 2 as in the first embodiment.

A spacer 21 is similar to those in the other embodiments in the respect that the spacer 21 contacts the photoconductor 2 at three points, two points at both ends of the arc of the inner photoconductor contact face 21*a*1, and one point of the outer photoconductor contact face 21*a*2 provided to the protrusion 30.

The protrusion 30 is provided to the inner leg 24 in the axial direction of the photoconductor 2 and accordingly a portion that contacts the photoconductor 2 can be restricted to the protrusion 30 protruding with respect to its surrounding. Consequently, the precision of the contact face 21*a* with the photoconductor 2 becomes easier to be ensured than the other embodiments. Consequently, the distance of an optical writing head 4 to the photoconductor 2 can be further stabilized.

Description of Optical-Writing-Head Positioner of Fourth Embodiment of the Present Disclosure In the first embodiment of the present disclosure, the configuration has been illustrated in which, among the edges, which contact the photoconductor 2, of the leg 24 having the inner photoconductor contact face 21*a*1, the outer edge E1 of the spacer 21 is R-chamfered at R 0.03 [mm] or less.

The configuration has the effect that the adhered substance Z on the surface of the photoconductor 2 comes into contact with the edge E1 due to the rotation of the photoconductor 2 in the axial direction, and the adhered substance Z can be scraped away.

However, the adhered substance Z scraped by the edge E1 tends to flow again from the edge E1 to the surface of the photoconductor 2, and may adhere again to the photoconductor 2. Hence, depending on the scraping of the edge E1, the adhered substance Z may not be able to be removed from the surface of the photoconductor 2.

Figure 13:
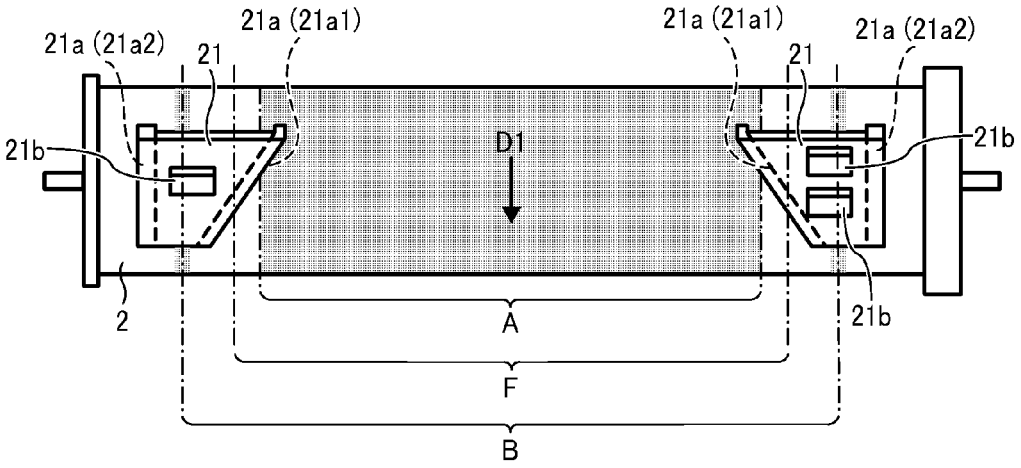
FIG. 13 is a schematic view of a configuration of an optical-writing-head positioner according to a fourth embodiment of the present disclosure.

In an optical-writing-head positioner according to a fourth embodiment of the present disclosure, an inner photoconductor contact face 21*a*1 is provided in a cleaning area B as illustrated in FIG. 13. (Besides the cleaning area B, FIG. 13 shows a maximum image formation area A and a maximum sheet width F in a photoconductor 2.) Consequently, even if an adhered substance Z scraped by an edge E1 is moved again onto the surface of a photoconductor 2, the adhered substance Z is scraped by a cleaning blade 6 before adhering again to the photoconductor 2. Consequently, the adhesion onto the surface of the photoconductor 2 can be prevented.

Up to this point, the embodiments of the present disclosure have been described. However, the present disclosure is not limited to the above-mentioned embodiments, and various modifications can be naturally added within the scope that does not deviate from the spirit of the present disclosure. The optical-writing-head positioner 20 of the present disclosure has been described as a positioner with respect to the drum-shaped photoconductor 2. However, the photoconductor 2 may be a belt-shaped photoconductor. In this case, in terms of the axial direction of the photoconductor 2 herein, the direction of the rotation axis of a roller or the like around which a belt is stretched is set as the axial direction.

The image forming apparatus according to the present disclosure is not limited to a monochromatic image forming apparatus illustrated in FIG. 1, and may be, for example, a color image forming apparatus, a copier, a printer, a facsimile machine, or a multifunction peripheral of them. Moreover, the image forming apparatus according to the present disclosure can also be allied to a tandem intermediate transfer system, a direct tandem system, or a four-cycle system.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An optical-writing-head positioner, comprising:

a spacer, disposed between a latent image bearer to bear a latent image and an optical writing head to expose the latent image bearer to light to form a latent image on a surface of the latent image bearer, to position the optical writing head with respect to the latent image bearer, wherein the spacer includes plural contact faces with the latent image bearer in an axial direction of the latent image bearer, the plural contact faces include a contact face having an arc with a radius of curvature equal to or less than a radius of the latent image bearer and one of the a contact face having an arc with a radius of curvature greater than the radius of the latent image bearer and a flat contact face to contact the surface of the latent image bearer, and wherein the contact face has a surface roughness Ra within a range of from $0.3\times10^{-6}$ m or more to $5.0\times10^{-6}$ m or less.

2. The optical-writing-head positioner according to claim 1, wherein the plural contact faces are placed at both sides of and away from a boundary of a cleaning area in which a cleaner cleans the surface of the latent image bearer.

3. The optical-writing-head positioner according to claim 1, wherein an edge of at least one of the plural contact faces of the spacer with the latent image bearer is inclined from an upstream side toward a downstream side in a rotation direction of the latent image bearer so as to be increasingly away from an image formation area on the latent image bearer.

4. The optical-writing-head positioner according to claim 1, wherein the spacer is provided with a rib portion extending in a rotation direction of the latent image bearer, and a leading end face of the rib portion contacts the latent image bearer.

5. The optical-writing-head positioner according to claim 4, wherein the leading end face of the rib portion has a width within a range of from 0.1 mm or more to 0.6 mm or less.

6. The optical-writing-head positioner according to claim 1, wherein a load to be applied by the optical writing head to the spacer is set within a range of from 3 N or more to 8 N or less.

7. The optical-writing-head positioner according to claim 1, wherein an edge of the spacer to contact the latent image bearer is R-chamfered at R 0.03 mm or less, C-chamfered at C 0.03 mm or less, or forms a right angle.

8. A process unit, comprising:

the latent image bearer to form the latent image with exposure by the optical writing head; and the optical-writing-head positioner according to claim 1 to position the optical writing head with respect to the latent image bearer.

9. An image forming apparatus, comprising the optical-writing-head positioner according to claim 1.

* * * * *